US011022312B2

(12) United States Patent
Chabaille et al.

(10) Patent No.: US 11,022,312 B2
(45) Date of Patent: Jun. 1, 2021

(54) CONNECTION DEVICE COMPRISING SEVERAL CURVED CONCENTRIC TUBES

(71) Applicant: Safran Aircraft Engines, Paris (FR)

(72) Inventors: Christophe Chabaille, Levallois Perret (FR); Sébastien Loval, Moissy-Cramayel (FR); Bénédicte Leleu, Paris (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 494 days.

(21) Appl. No.: 15/504,387

(22) PCT Filed: Aug. 19, 2015

(86) PCT No.: PCT/FR2015/052224
§ 371 (c)(1),
(2) Date: Feb. 16, 2017

(87) PCT Pub. No.: WO2016/027034
PCT Pub. Date: Feb. 25, 2016

(65) Prior Publication Data

US 2017/0234539 A1 Aug. 17, 2017

(30) Foreign Application Priority Data

Aug. 20, 2014 (FR) ..... 14 57895

(51) Int. Cl.
*F23R 3/28* (2006.01)

(52) U.S. Cl.
CPC ..... *F23R 3/283* (2013.01)

(58) Field of Classification Search
CPC .... F23R 3/283; F23R 3/32; F23R 3/36; F23R 3/60; F02C 7/222; F02C 7/224; F02C 7/24
See application file for complete search history.

(56) References Cited

U.S. PATENT DOCUMENTS 4,258,247 A * 3/1981 Shimada ..... B23K 33/004 219/137 R
4,609,154 A * 9/1986 Rinkewich ..... A01G 25/09 138/115
4,735,044 A 4/1988 Richey
5,918,628 A 7/1999 Harding
(Continued)

FOREIGN PATENT DOCUMENTS

FR 2 494 777 5/1982

OTHER PUBLICATIONS

Search Report issued in French Patent Application No. 14 57895 dated Apr. 8, 2015.

(Continued)

*Primary Examiner* — Todd E Manahan
*Assistant Examiner* — Thuyhand N Nguyen
(74) *Attorney, Agent, or Firm* — Pearne & Gordon LLP

(57) ABSTRACT

The invention concerns a connection device (14) for connecting a turbomachine member such as an injector, to a system for supplying a fluid such as fuel, the connection device (14) comprising several concentric tubes (26, 28, 30) delimiting conduits (20, 22, 24) for supplying the member, which are curved in at least one direction, characterised in that it is made from a single part comprising at least the tubes (26, 28, 30).

15 Claims, 1 Drawing Sheet

(56) References Cited

U.S. PATENT DOCUMENTS

| | | | | |
|---|---|---|---|---|
| 6,358,041 | B1 * | 3/2002 | Whittaker | C01B 3/363 239/132.3 |
| 6,915,638 | B2 * | 7/2005 | Runkle | F02C 7/224 239/424 |
| 7,832,377 | B2 * | 11/2010 | Lee | F23R 3/283 123/470 |
| 8,336,313 | B2 * | 12/2012 | McMasters | F23R 3/343 60/742 |
| 8,443,608 | B2 * | 5/2013 | Williams | F23R 3/36 60/740 |
| 2003/0182945 | A1 | 10/2003 | Runkle | |
| 2009/0255102 | A1 | 10/2009 | McMasters | |
| 2009/0255602 | A1 | 10/2009 | McMasters | |
| 2011/0247590 | A1 | 10/2011 | Donovan | |
| 2016/0017808 | A1 | 1/2016 | Chabaille | |

OTHER PUBLICATIONS

International Search Report and Written Opinion issued in Application No. PCT/FR2015/052224 dated Mar. 5, 2016.

* cited by examiner

CONNECTION DEVICE COMPRISING SEVERAL CURVED CONCENTRIC TUBES

TECHNICAL FIELD

The invention relates to a device making the connection of a turbomachine member, such as an injector of an aircraft turbomachine, with a fuel supply system.

The invention more particularly relates to a connection device including several identically curved concentric tubes.

STATE OF PRIOR ART

An aircraft turbomachine includes in particular a fuel supply system comprising an injector the purpose of which is to inject a certain amount of fuel in the combustion chamber of the turbomachine. The amount of fuel injected depends on the operating conditions of the turbomachine.

An injector, in particular of the aeromechanical type, comprises a first so-called primary exhaust flow, which is used during a starting phase of the turbomachine and a second so-called secondary exhaust flow, which is used after starting the turbomachine, and through which a significant fuel flow rate is provided.

The supply system provides several different fuel flows to the injector. Each of these different flows is associated with and supplies an exhaust flow of the injector, that is a primary flow supplying the primary exhaust flow, and a secondary flow supplying the secondary exhaust flow.

A connection device is arranged between the injector and the supply system, to lead the different fuel flows through restricted spaces.

Because of the small space available for conveying fuel flows, the connection device comprises several concentric tubes which delimit several conduits through which the fuel flows circulate.

Generally, a connection device comprises three tubes which delimit three concentric conduits. A first central conduit is associated with the primary flow, a second radially intermediate conduit is associated with the secondary flow and a third radially outer conduit is associated with a fuel flow making a thermal protection of the primary and secondary fuel flows.

The tubes of the connection device are bent, or curved, to gain access to the location of the injector associated, by taking the integration requirements on the turbomachine into account.

According to a conventional manufacturing mode, the tubes are simultaneously curved.

To that end, helical springs are installed between the tubes, to keep the tubes remote from each other during curving operations.

However, as a result of these curving operations, the thickness of the tubes is not constant over the entire length thereof, there are manufacturing dispersions or even proofness issues.

The purpose of the invention is to provide a connection device enabling these issues to be solved.

DISCLOSURE OF THE INVENTION

The invention provides a device for connecting a member to a system for supplying the member with fluid, the connection device including several concentric tubes delimiting conduits for supplying the member, which are curved along at least one direction, characterised in that it is made as a single piece including at least the tubes.

Preferably, the connection device includes at least one radial rib extending between two adjacent tubes, which extends along the central curve of the tubes over the entire length of said adjacent tubes.

Preferably, each rib is made as a single piece with said adjacent tubes.

Preferably, the connection device includes three concentric tubes and two sets of ribs, the ribs of a first set of ribs connecting the outer surface of the radially inner tube to the inner surface of the radially intermediate tube and the ribs of the second set of ribs connecting the outer surface of the radially intermediate tube to the inner surface of the radially outer tube.

Preferably, fillets are formed at each radial end of each rib, at the connection of said radial end of the rib with the wall facing an associated tube.

Preferably, the connection device includes a body for connecting the tubes with a fluid injecting system, and said body is made as a single piece with the tubes and the ribs.

Preferably, the body includes a securing plate and fillets are formed at the connection between the outer surface of the radially outer tube and each surface of the plate.

Preferably, the connection device is made by implementing a direct metal laser fusion method.

The invention also relates to a circuit for supplying with fluid a turbomachine member such as a fuel injector for a combustion chamber of an aircraft turbomachine characterised in that it includes a connection device according to the invention.

The invention also relates to an aircraft turbomachine including at least one member connected to a system for supplying the member with fluid by a connection device according to the invention.

BRIEF DESCRIPTION OF THE DRAWINGS

Further characteristics and advantages of the invention will appear upon reading the detailed description that follows for the understanding of which the appended figures will be referred to in which.

DETAILED DISCLOSURE OF PARTICULAR EMBODIMENTS

Figure 1:
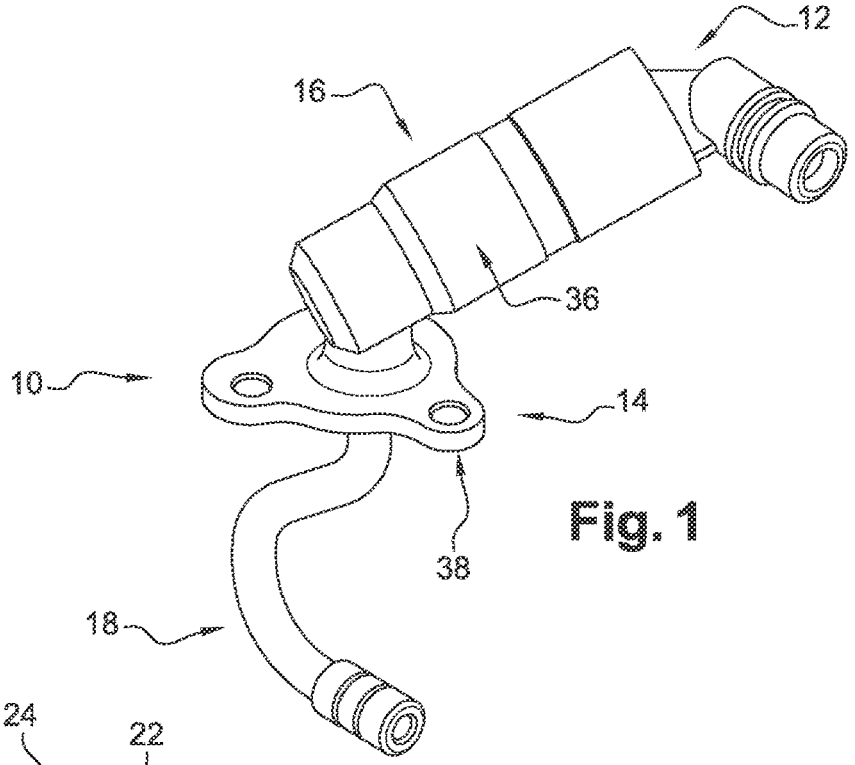
FIG. 1 is a perspective schematic representation of a fuel supply circuit of an injector including a connection device according to the invention.

In FIG. 1, a circuit 10 is represented for supplying with fuel a fuel injector (not represented) for a combustion chamber of an aircraft turbomachine.

This injector is designed to be able to selectively inject two distinct fuel flows. These fuel flows are a primary flow, which is injected during a starting phase of the turbomachine and which is not much significant, and a more significant secondary flow, which is injected when the turbomachine is in use.

Since the specificities of each of both fuel flows are different, both these flows are consequently separated at the injector exhaust as well as in the entire supply circuit 10.

The supply circuit 10 also includes a supply system 12 which distributes a single fuel flow from a high pressure pump, into several different flows supplying the injector, and controls the pressure and the flow rate of each of these fuel flows.

The supply system 12 is connected to the injector through a connection device 14.

This connection device 14 includes a body 16 which is connected to the supply system 12 and a piping 18 extending from the body 16 to the injector.

Figure 2:
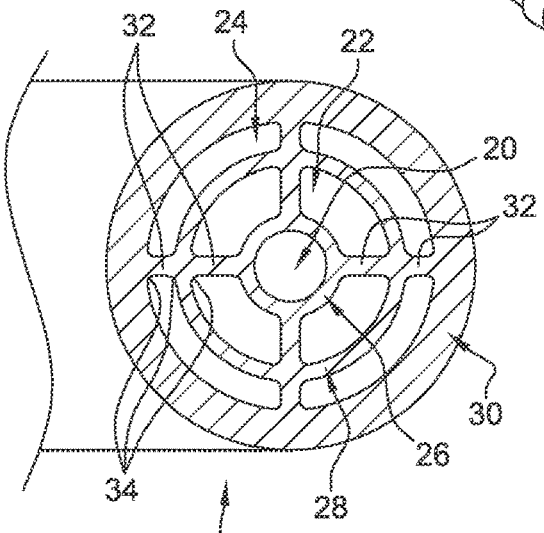
FIG. 2 is a radial cross-section view of the connection device showing the different tubes and radial ribs.
Figure 3:
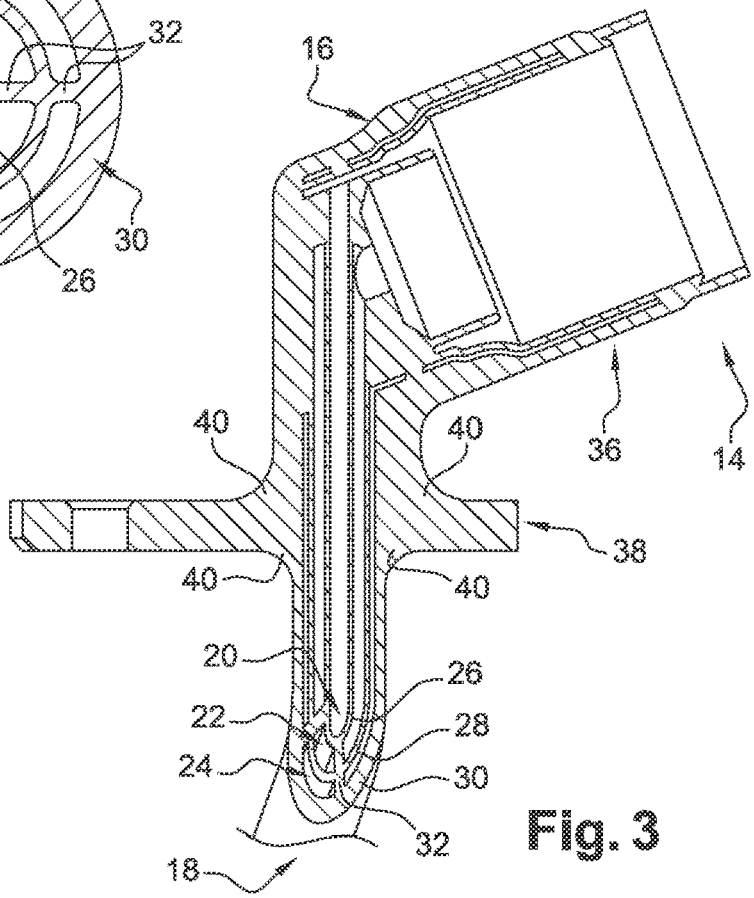
FIG. 3 is an axial cross-section view of the connection device showing the body of the connection device with the tubes.

The piping 18 is shaped to circulate the different fuel flows towards the injector. For that purpose, the piping 18 is divided into several concentric supply conduits 20, 22, 24, herein three in number as can be seen more in detail in FIG. 2.

The piping 18 includes a first radially inner conduit 20 which is associated with the first fuel flow, a second radially intermediate conduit 22 which is associated with the second fuel flow and a third radially outer conduit 24 which is associated with a stagnant fuel flow acting as a heat screen. This stagnant fuel in the third conduit 24 aims at protecting the other two fuel flows from heat, and thus at avoiding in particular fuel cocking phenomena inside the fuel injector.

The piping 18 consists of several concentric tubes 26, 28, 30, three in number, which delimit the conduits 20, 22, 24. The first conduit 20 is thus delimited by the radially inner tube 26, the second conduit 22 is delimited by the radially inner tube 26 and the intermediate tube 28 and the third conduit 24 is delimited by the intermediate tube 28 and the radially outer tube 30.

The tubes 26, 28, 30 are connected to the body 16 of the connection device 14.

The piping 18 is curved, to enable the connection device to be integrated to the turbomachine by taking the other components of the turbomachine located in the proximity thereof into account. Consequently, the concentric tubes 26, 28, 30 are also curved along at least one direction.

The piping 18 also includes means for keeping the tubes 26, 28, 30 remote from each other, which consist of a plurality of radial ribs 32.

Each rib 32 is curved in the same way as the piping 18, that is it radially extends along the central curve of the piping 18 and the tubes 26, 28, 30, over the entire length of the tubes 26, 28, 30.

The ribs 32 are located in the second conduit 22 and in the third conduit 24, thus forming two sets of ribs, the ribs 32 of the first set of ribs extending in the second conduit 22, the ribs 32 of the second set of ribs 32 extending in the third conduit 24.

Here, each set of ribs includes four ribs 32 distributed at 90 degrees. It will be understood that a set of ribs can include a different member of ribs 32 without departing from the invention.

Likewise, the ribs 32 of both sets of ribs are disposed about the central curve of the piping 18 with two adjacent ribs 32 being aligned.

According to the embodiment represented in the figures, the ribs 32 are all of the same thickness. According to an alternative embodiment, some ribs 32 have a different thickness from the thickness of the other ribs 32, to locally modify the mechanical strength to the piping 18. Consequently, the thickness of a rib can vary along the central curve of the piping 18.

Each radial end of each rib 32 comprises an extra material forming a fillet 34 at its connection with the associated face of a tube 26, 28, 30. These fillets 34 are intended to remove the sharp edges that can locally embrittle the connection between a rib and the wall facing a tube 26, 28, 30.

The body 16 of the connection device 14 comprises a cylindrical part 36 which is for receiving a complementary part of the supply system 12 and which separately communicates with each of the conduits 20, 22, 24.

The body 16 includes a plate 38 for securing the connection device 14 to the turbomachine. This securing plate 38 extends about the radially outer tube 30 and fillets 40 are formed at the connection between the securing plate 38 and the outer tube 30.

Preferably, all the tubes 26, 28, 30 are made as a single piece from a same material.

According to another aspect of the connection device 14, the ribs 32 are made as a single piece with the tubes 26, 28, 30.

According to yet another aspect of the connection device 14, the body 16 of the connection device is made as a single piece with the tubes 26, 28, 30 and the ribs 32.

Thus, according to a preferred embodiment of the invention, the entire connection device 14 is made as a single piece.

According to a preferred embodiment, the connection device 14 is made by implementing a so-called direct metal laser fusion method. Such a method consists in distributing an even layer of metal powder by means of a recoating device, and then melting this layer at given locations corresponding to a section of the connection device in a highly controlled inert atmosphere. These operations are repeated several times until the connection device 14 is obtained. Once ended, the connection device 14 is removed from the powder bed and subjected to a heat treatment and a finish.

Thus, the connection device 14 does not undergo any shaping step which would be complex to implement and would be at risk of locally embrittling it.

All the parts of the connection device 14 are made in a single material which is for example a Cobalt Chromium Molybdenum alloy or an alloy known as Inconel 718.

Such an embodiment of the connection device 14 has the further advantage that no proofness means is necessary between the different tubes 26, 28, 30 and the body 16 of the connection device, thus reducing the risks of fuel leaks or incidental communication of two conduits 20, 22, 24.

Thereby, the strength of the connection device 14 is improved since it is possible to adapt the thickness of a tube 26, 28, 30 or a rib 32 as a function of the stresses it undergoes.

What is claimed is:

1. A connection device for connecting a member to a supply system for supplying the member with fluid, the connection device including:

several concentric tubes delimiting conduits for supplying the fluid to the member, wherein the member is a fuel injector and the fluid is a fuel, the several concentric tubes being curved along at least one direction, and further including a first set of ribs and a second set of ribs, the first set of ribs extending between two adjacent tubes of the several concentric tubes, the second set of ribs disposed radially outward of the first set of ribs with respect to the at least one direction, each tube of the several concentric tubes having an inlet, an outlet, and a conduit extending therebetween to define a length of said tube, the first and second set of ribs extending along a central curve of the tube over the entire length of said tube along the at least one direction, wherein the first and second set of ribs and the two adjacent tubes form a single integral piece, such that the first set of ribs extends directly between adjacent walls of the two adjacent tubes.

2. The connection device according to claim 1, wherein the ribs of the first set of ribs connect an outer surface of a radially inner tube to an inner surface of a radially intermediate tube, and the ribs of the second set of ribs connect an outer surface of the radially intermediate tube to an inner surface of a radially outer tube.

3. The connection device according to claim 1, wherein fillets are formed at each radial end of each rib of the first set of ribs or the second set of ribs, at a connection of said radial end with a facing wall of an associated tube of the several concentric tubes.

4. The connection device according to claim 1, further including a body for connecting the several concentric tubes with a fuel injecting system, and in that said body is made as a single piece with the several concentric tubes and at least one rib of the first set of ribs or the second set of ribs.

5. The connection device according to claim 4, wherein the body includes a securing plate, and wherein fillets are formed at a connection between an outer surface of radially outer tube and each surface of the securing plate.

6. The connection device according to claim 1, wherein the connection device is made by implementing a direct metal laser fusion method.

7. A circuit for supplying with fluid a turbomachine member, the member being a fuel injector for a combustion chamber of an aircraft turbomachine wherein the turbomachine member includes a connection device according to claim 1.

8. An aircraft turbomachine including at least one member connected to a system for supplying the member with fluid by a connection device according to claim 1.

9. The connection device according to claim 1, further including a body coupled to the several concentric tubes and configured to receive a complementary part of the supply system at an opening of the body, wherein respective fluid paths of inner concentric tubes of the several concentric tubes are fluidly coupled to the opening of the body, and wherein at least an outermost concentric tube of the several concentric tubes provides a stagnant fluid path.

10. A circuit for a supply system in a combustion chamber of an aircraft turbomachine, comprising:

a fuel injector including a connection device, the connection device comprising:

several concentric tubes delimiting conduits for supplying fuel to the fuel injector, which are curved along at least one direction, a first set of ribs and a second set of ribs, the second set of ribs disposed radially outward of the first set of ribs with respect to the at least one direction, wherein at least the several concentric tubes and the first and second set of ribs form a single integral piece, such that the first set of ribs extend directly between adjacent walls of adjacent concentric tubes of the several concentric tubes and the first and second set of ribs are curved with the adjacent walls along the at least one direction, and further including a body coupled to the several concentric tubes and configured to receive a complementary part of the supply system at an opening of the body, wherein respective fuel paths of inner concentric tubes of the several concentric tubes are fluidly coupled to the opening of the body, and wherein at least an outermost concentric tube of the several concentric tubes provides a stagnant fuel path.

11. The connection device according to claim 10, wherein the ribs of the first set of ribs connect an outer surface of a radially inner tube to an inner surface of a radially intermediate tube, and the ribs of the second set of ribs connect an outer surface of the radially intermediate tube to an inner surface of a radially outer tube.

12. The connection device according to claim 10, wherein fillets are formed at each radial end of each rib of the first set of ribs or the second set of ribs, at a connection of said radial end with a facing wall of an associated tube of the several concentric tubes.

13. The connection device according to claim 10, wherein said body is made as a single piece with the several concentric tubes.

14. The connection device according to claim 13, wherein the body includes a securing plate, and wherein fillets are formed at a connection between an outer surface of a radially outer tube and each surface of the securing plate.

15. The connection device according to claim 10, wherein the connection device is made by implementing a direct metal laser fusion method.

* * * * *